US010731406B1

(12) United States Patent
Kitterman et al.

(10) Patent No.: US 10,731,406 B1
(45) Date of Patent: Aug. 4, 2020

(54) SHUTTER SYSTEM

(71) Applicant: ASCEND SHUTTERS, Gilbert, AZ (US)

(72) Inventors: Mark Kitterman, Gilbert, AZ (US); Aaron W. Kitterman, Gilbert, AZ (US)

( * ) Notice: Subject to any disclaimer, the term of this patent is extended or adjusted under 35 U.S.C. 154(b) by 0 days.

(21) Appl. No.: 16/565,279

(22) Filed: Sep. 9, 2019

(51) Int. Cl.
*E06B 9/02* (2006.01)
*E06B 7/08* (2006.01)

(52) U.S. Cl.
CPC . *E06B 9/02* (2013.01); *E06B 7/08* (2013.01)

(58) Field of Classification Search
CPC ..... E06B 7/08; E06B 9/02
See application file for complete search history.

(56) References Cited

U.S. PATENT DOCUMENTS 1,427,620 A * 8/1922 Mushall ..... E06B 9/52 160/376
1,487,970 A * 3/1924 Mushall ..... E06B 9/52 160/376
1,723,095 A * 8/1929 Tate ..... B60J 1/2088 160/172 R
1,888,522 A * 11/1932 Ward ..... E06B 7/084 49/86.1
2,167,840 A * 8/1939 Hepworth ..... E06B 9/302 160/172 R
2,708,295 A * 5/1955 Johnson ..... E06B 7/084 49/82.1
3,001,250 A * 9/1961 Stanhope ..... E06B 7/084 49/87.1
3,360,910 A * 1/1968 Soltis ..... B01D 46/12 55/483
3,717,195 A * 2/1973 Larranaga ..... E06B 9/302 160/169
3,744,544 A * 7/1973 Wellensiek ..... E06B 9/302 160/169
4,313,650 A * 2/1982 Ward ..... A01G 9/222 359/596
4,850,138 A * 7/1989 Watanabe ..... E06B 7/086 49/82.1
5,392,561 A * 2/1995 Henley, Sr. ..... E06B 7/086 49/74.1
5,469,658 A * 11/1995 Digianni ..... E06B 7/086 160/176.1 R
5,469,906 A * 11/1995 Cason ..... B60J 1/2011 160/105

(Continued)

*Primary Examiner* — James M Ference
(74) *Attorney, Agent, or Firm* — Schmeiser, Olsen & Watts LLP

(57) ABSTRACT

Embodiments of a panel-less shutter assembly comprise a series of parallel louvers mounted within a closed rectangular rail frame. Spring-loaded guides may be mounted between the rail frame and the window frame to self-center the assembly within the opening of the window frame. Carriers mounted on the ends of the louvers glide up and down within channels of the side rails to allow raising and lowering of the louvers. Spring-loaded channel slides may be coupled to the carriers. The channel slides have tabs that extend through slots in the side rails to maintain the positions of the louvers relative to the side rails. The tabs have a diagonal surface that engages the top edge of the slot to disengage the tab from the slot when a user raises the louvers. A method of using a panel-less shutter assembly is also disclosed.

15 Claims, 16 Drawing Sheets

(56) References Cited

U.S. PATENT DOCUMENTS 5,584,331 A * 12/1996 Lin ..... E06B 7/086 160/172 R
5,595,231 A * 1/1997 Marocco ..... E06B 9/303 160/168.1 R
6,029,401 A * 2/2000 Gale ..... E06B 7/082 49/465
6,041,547 A * 3/2000 Marocco ..... E06B 7/086 49/403
6,314,680 B1 * 11/2001 Buckwalter ..... E06B 7/096 49/74.1
6,536,162 B2 * 3/2003 LaMay ..... E06B 7/086 403/383
6,675,534 B2 * 1/2004 Marocco ..... E06B 7/086 49/74.1
6,848,213 B1 * 2/2005 Swapp ..... E06B 7/096 49/74.1
6,953,074 B2 * 10/2005 Cardinal ..... E06B 9/0638 160/168.1 R
7,331,370 B1 * 2/2008 Militello ..... E06B 9/322 160/170
7,353,636 B1 * 4/2008 Anderson ..... E06B 7/086 49/74.1
7,896,056 B2 * 3/2011 Ben-David ..... E06B 9/264 160/107
8,201,609 B1 * 6/2012 Kitterman ..... E05D 15/582 160/172 R
8,528,254 B1 * 9/2013 Johnston ..... E04F 10/08 49/64
8,555,948 B2 * 10/2013 Park ..... E06B 9/0676 160/172 R
2003/0015300 A1 * 1/2003 Colson ..... E06B 7/086 160/168.1 R
2004/0045220 A1 * 3/2004 Fraser ..... E06B 7/084 49/74.1
2005/0005523 A1 * 1/2005 Johnston ..... E06B 7/09 49/74.1
2006/0225844 A1 * 10/2006 Gittens ..... E06B 9/382 160/115
2007/0187048 A1 * 8/2007 Hung ..... E06B 9/04 160/168.1 R
2007/0193702 A1 * 8/2007 Hung ..... E06B 7/086 160/172 R
2008/0099160 A1 * 5/2008 Chen ..... E06B 9/04 160/172 R
2009/0223149 A1 * 9/2009 Zalesak ..... E06B 7/09 52/204.1
2012/0097343 A1 * 4/2012 O'Hair ..... E06B 9/307 160/168.1 R
2012/0193038 A1 * 8/2012 Corey ..... E06B 9/262 160/84.05
2012/0233924 A1 * 9/2012 Kitterman ..... E05F 17/00 49/77.1
2014/0033610 A1 * 2/2014 Watkins ..... E06B 7/086 49/82.1
2014/0318720 A1 * 10/2014 Watkins ..... E05F 17/00 160/176.1 R

* cited by examiner

SHUTTER SYSTEM

BACKGROUND OF THE INVENTION

Technical Field

This invention relates generally to window treatments and more particularly to a panel-less shutter assembly.

State of the Art

There are several types of window treatments available, most of which require some form of measuring the dimensions of a particular window and seeking a window treatment that fits the window. Windows are generally of common dimensions, with variations in those dimensions or a window that is out-of-square, for reasons such as construction error or settling of the house foundation. These slight variations are of particular concern when installing shutters, shutter blinds or like window treatments. When shutters are installed onto windows, a precise measurement must be made in order to best fit the shutter to the window. The shutters are then made to the precise measurements and installed.

In order to avoid having to make such precise measurements and the related costs, the use of a face mount frame was introduced. This enabled the variations of the window size to be accounted for and corrected by first installing a window frame that would result in the proper size of frame for the shutters to be installed, allowing the shutters to be installed onto the face mount frame. The shutters were installed without the need of precise measurements to account for the small inconsistencies in window opening dimensions.

Conventional frames are able to house conventional shutters that include panels for retaining louvers and a louver bar for rotating the louvers into an open position. Hinges are used to connect the shutter panel to the frame to provide egress or access to the window. Traditional shutter panels reduce the viewable area of the window when the louvers are rotated, reducing the amount of natural light that may enter or restricting the view out of a scenic window.

Additionally, conventional shutters employ what is commonly referred to as panels that are hingedly coupled to a frame. There are typically four panels that surround the louvers of the shutters, the panels forming a type of door-like structure. The louvers are rotated by use of a louver bar coupled to the outside of the louvers, the louver bar allowing a user to grasp the louver bar and move it vertically to change the angle the of the louvers in order to provide various points of opening of the louvers. For egress, the panels are hinged on one side and a user can rotate the panels away from the window for reasons that require access to the window.

These conventional shutters have limitations. The panels are required to retain the louvers and to provide egress to the window. Further, the installation of conventional shutters is a task that requires professional installation, particularly since the dimensions of windows are not exact, making it difficult to self-install shutters. The installation requires pre-measurement of all dimensions of windows to be treated and then custom manufacture of the shutters for the windows. This increases the cost of manufacture dramatically and further increases the time it takes to install the shutters.

Accordingly, there is a need in the window treatment field for a panel-less shutter assembly.

SUMMARY OF THE INVENTION

The present invention relates generally to window treatments and more particularly to a panel-less shutter assembly.

Embodiments of a panel-less shutter assembly, of the present invention, comprise a rectangular rail frame and a plurality of louvers operationally coupled thereto.

The rail frame may be a closed rectangular frame comprising four rail members. Each of the four rail members may have a generally U-shaped cross section, with a channel facing inward, and may have a facing coupled thereto along an inner front edge of an arm thereof, thereby forming a groove, between the inner surface of the facing and the outer surface of the arm, for receiving fascia.

The rail frame may be configured to fit within the opening of a window frame, leaving a gap between each of the four rail members and the inner surfaces of the window frame. The fascia described above conceals the gap. In some embodiments, the rail frame is configured to be self-centering within the opening of the window frame. In a preferred embodiment, the rail frame comprises two spaced spring-loaded upper guides coupled to the top rail thereof and two spaced spring-loaded lower guides coupled to the lower rail thereof. In such embodiments, the springs within the spring-loaded guides operate to bias the guides against the top and bottom inner surfaces of the window frame, respectively, such that the rail frame is self-centered between the top and bottom inner surfaces of the window frame.

In some embodiments, each of the guides is of uniform depth and is disposed such that the rear surfaces thereof engage the inner surface of the window pane or framework thereof.

A panel-less shutter assembly of the present invention further comprises a plurality of louvers operationally mounted horizontally within the rail frame in a parallel configuration. Each end of each of the plurality of louvers may be rotationally coupled to a carrier that is configured to be inserted into the channels of the left and right vertical rails, respectively. Each louver may thereby be rotated with respect to the carriers, about an axis of rotation, the axis of rotation coinciding with the line between the carrier coupled to a first end of the louver and the carrier coupled to the second end of the louver. Each carrier is configured to slide up and down within the channels of the left and right vertical rails, respectively, thereby allowing the louvers to be raised and lowered with respect to the rail frame.

In some embodiments, each of the plurality of louvers may be connected, in series, by a pair of flexible connecting devices whereby the plurality of louvers may be configured to be rotated between an open configuration and a closed configuration in unison.

Some embodiments may comprise one or more vertical center rails coupled between the bottom rail and the top rail at a position between the left and right side rails. A center rail divides the rail frame into sections and is particularly useful in applications for wide window openings.

In some embodiments, the carriers coupled to each end of each louver may be coupled thereto at a location that is off-center between the top edge and the bottom edge of the louver. Because the axis of rotation is therefore off-center, the louver may tend to fall to an open position in response to the force of gravity acting on the louver.

Some embodiments may comprise a mechanism, such as a detent mechanism, for allowing the louvers to snap into an open position, a closed position, or any of a variety of positions between an open position and a closed position.

In operation, a user may grasp the bottom louver and lift it upward, thereby successively lifting each adjoining louver, until all of the louvers are stacked together, and the stack of louvers engages the top rail of the rail frame.

In some embodiments, the outer surface of each of the vertical side rails has a plurality of slots therethrough, each slot corresponding to the position of each corresponding louver when the louvers are in their original, and not lifted, positions. A carrier slide may be slidingly coupled to each carrier, wherein the carrier slide has an outward tab configured to extend outwardly through the slot while in the engaged position and retract inwardly, such that the outward tab does not extend through the slot, while in the disengaged position. The carrier slide is configured to slide between the engaged position and the disengaged position.

In operation, when a user lifts a first louver, wherein a second louver is disposed directly above the first louver, the carrier slide coupled to the first louver slides inward to a disengaged position in response to a slanted upper surface thereof engaging an upper surface of the slot. As each successive louver is raised, each corresponding carrier slide is biased in a disengaged position by the carrier slide above it, until all of the louvers have been raised to the lifted position.

In some embodiments, a trigger mechanism may be operationally coupled to the bottom carrier slide for engaging the bottom carrier slide and moving it inward to a disengaged position in response to a user pushing the trigger mechanism.

A method of using a panel-less shutter assembly is also disclosed.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in conjunction with the Figures, wherein like reference numbers refer to similar items throughout the Figures, and:

DETAILED DESCRIPTION OF EMBODIMENTS OF THE INVENTION

As discussed above, embodiments of the present invention relate generally to window treatments and more particularly to a panel-less shutter assembly.

Embodiments of a panel-less shutter assembly, of the present invention, comprise a rectangular rail frame and a plurality of louvers operationally coupled thereto.

Figure 1:
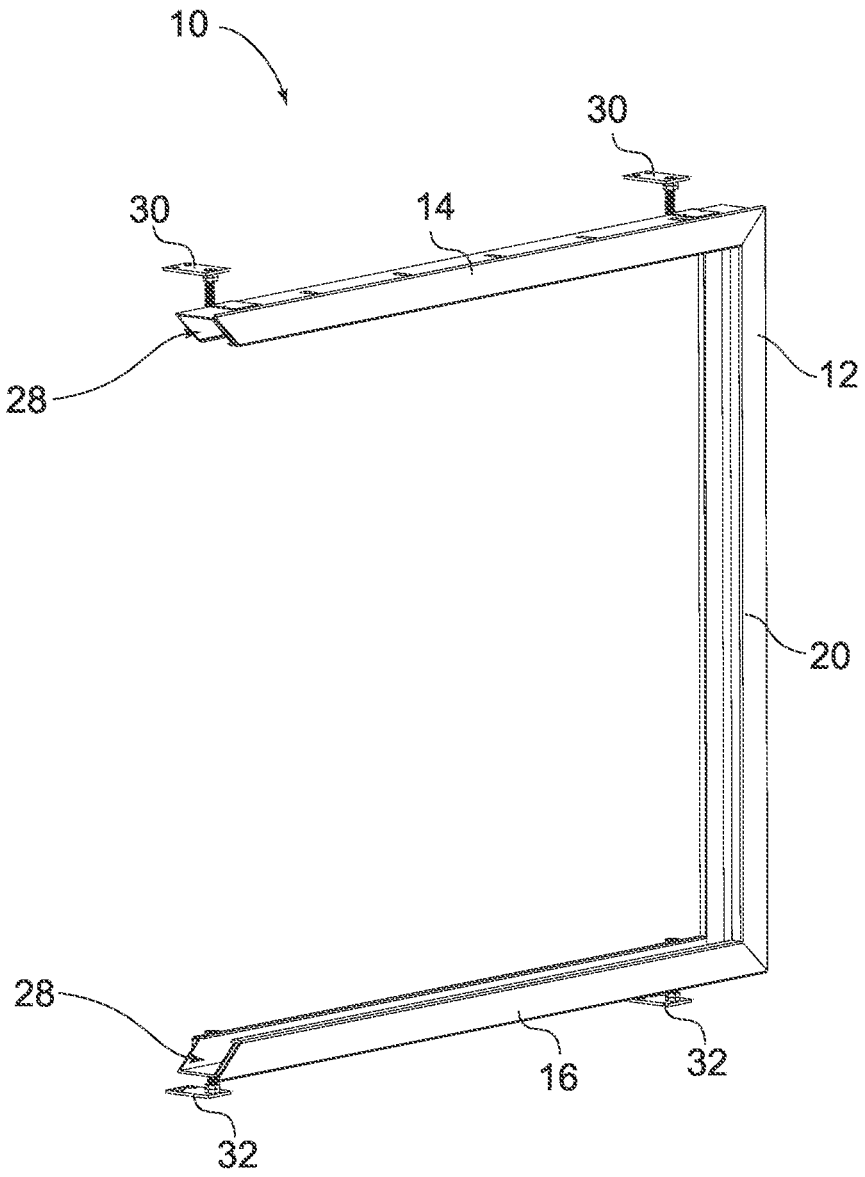
FIG. 1 is a front perspective view of a rail frame of a panel-less shutter assembly, according to an embodiment.
Figure 2:
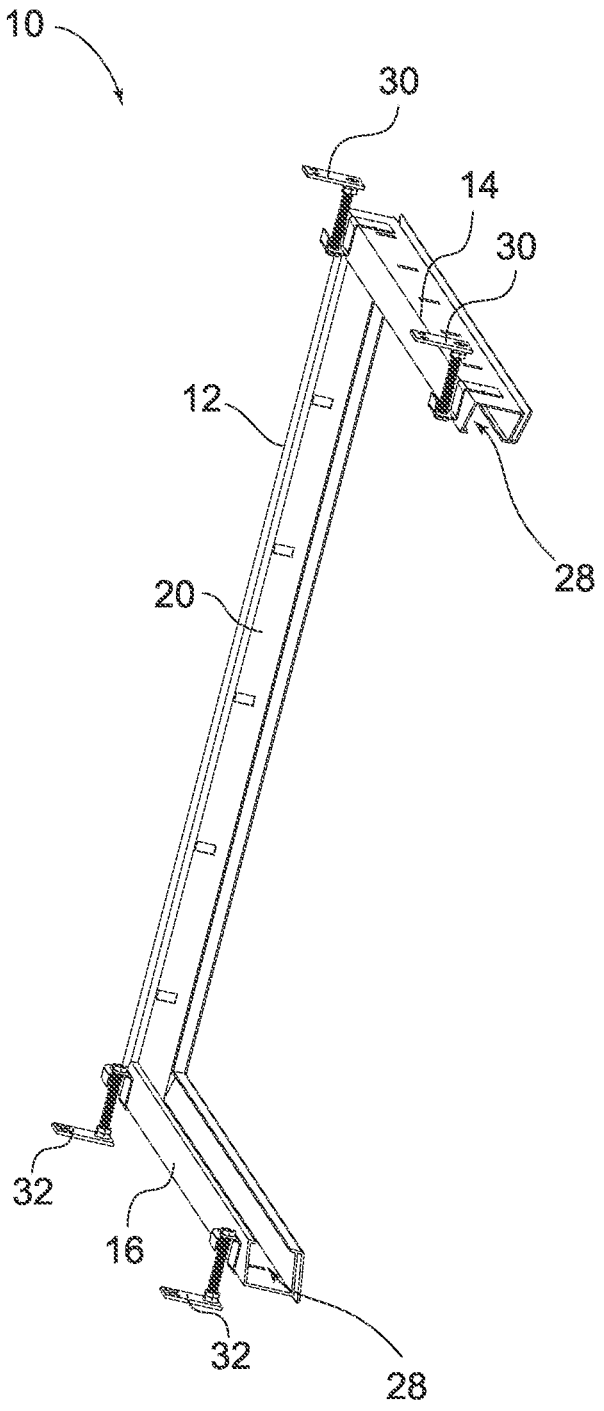
FIG. 2 is a rear perspective view of a rail frame of a panel-less shutter assembly, according to an embodiment.
Figure 3:
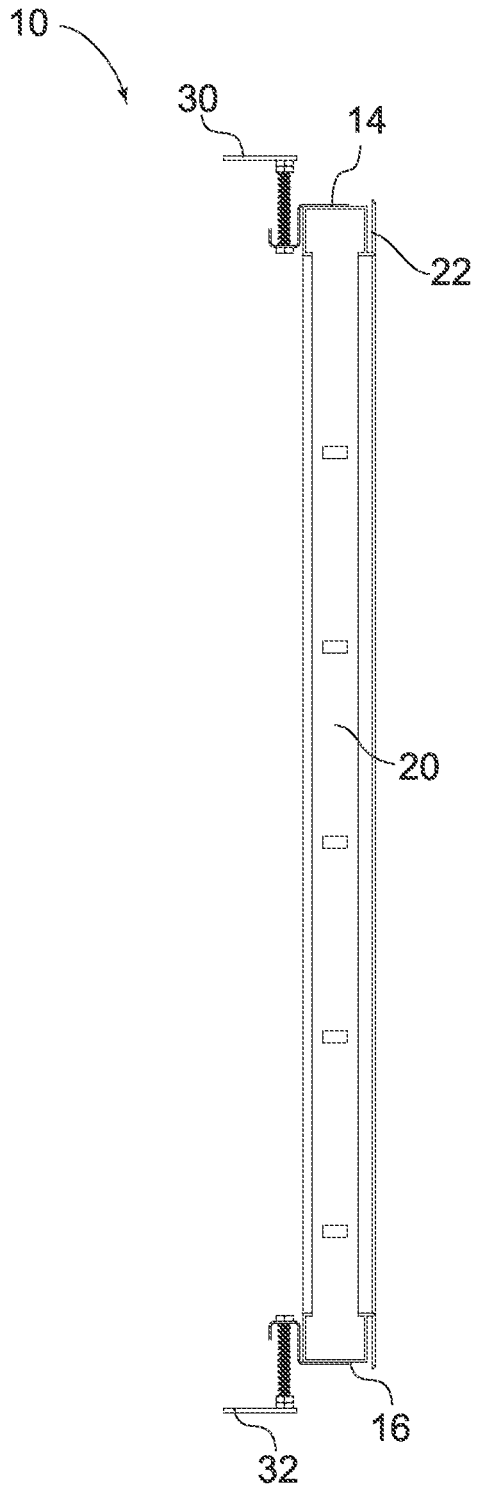
FIG. 3 is a side view of a rail frame of a panel-less shutter assembly, according to an embodiment.
Figure 4:
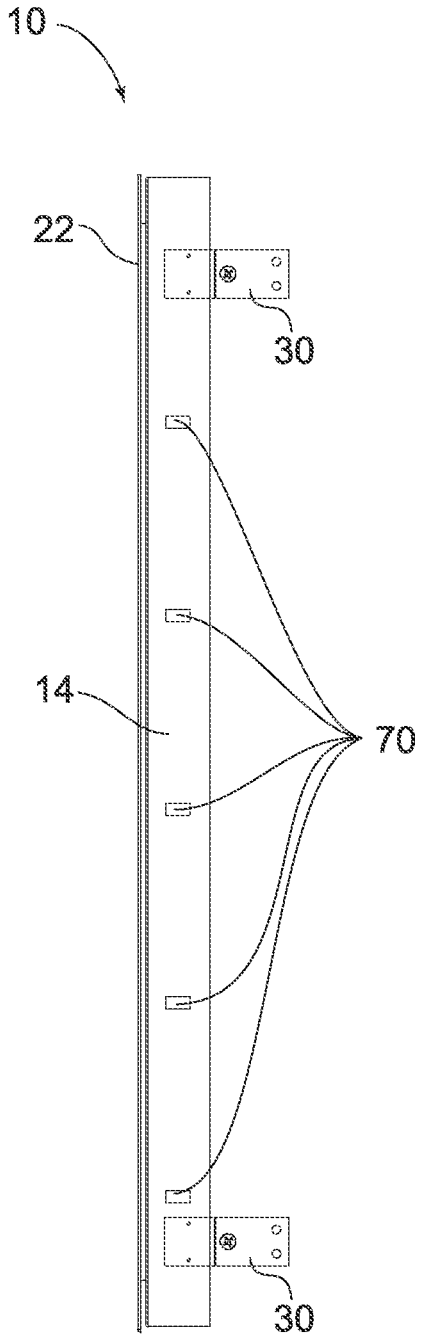
FIG. 4 is a top view of a rail frame of a panel-less shutter assembly, according to an embodiment.
Figure 5:
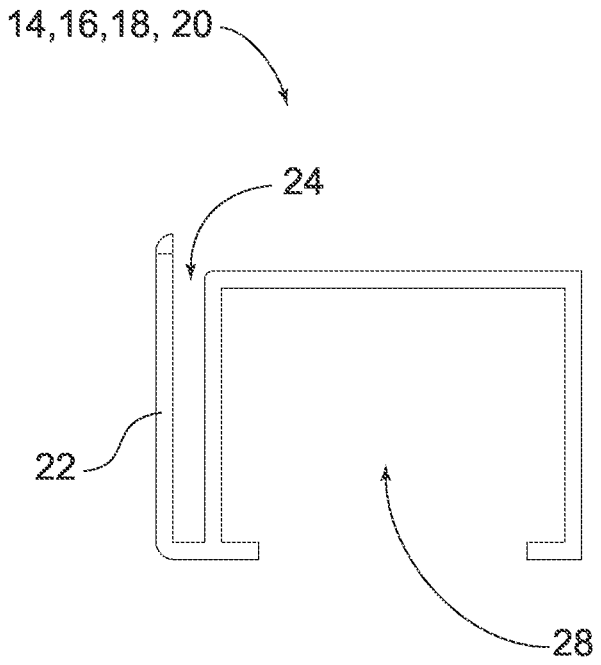
FIG. 5 is a cross section view of a rail of a panel-less shutter assembly, according to an embodiment.

Referring to the FIGS. 1-16, the rail frame 12 of a panel-less shutter assembly 10 may be a closed rectangular frame comprising four rail members consisting of a top rail 14, a bottom rail 16, and left and right side rails 18 and 20, wherein the top and bottom rails 14 and 16 are disposed horizontally and parallel to each other and the two side rails 18 and 20 are disposed vertically and parallel to each other, as shown in FIGS. 1-4. (The left side rail is not shown in FIGS. 1 and 2). As shown in FIG. 5, each of the four rail members 14, 16, 18, and 20 may have a generally U-shaped cross section and may have a facing 22 coupled thereto along an inner front edge of an arm thereof, thereby forming a groove 24, between the inner surface of the facing 22 and the outer surface of the arm, for receiving fascia as described in more detail below. In such embodiments, channel 28 of each of the four rail members having a U-shaped cross section, is inward-facing toward the center of the rectangular frame 12.

Figure 15:
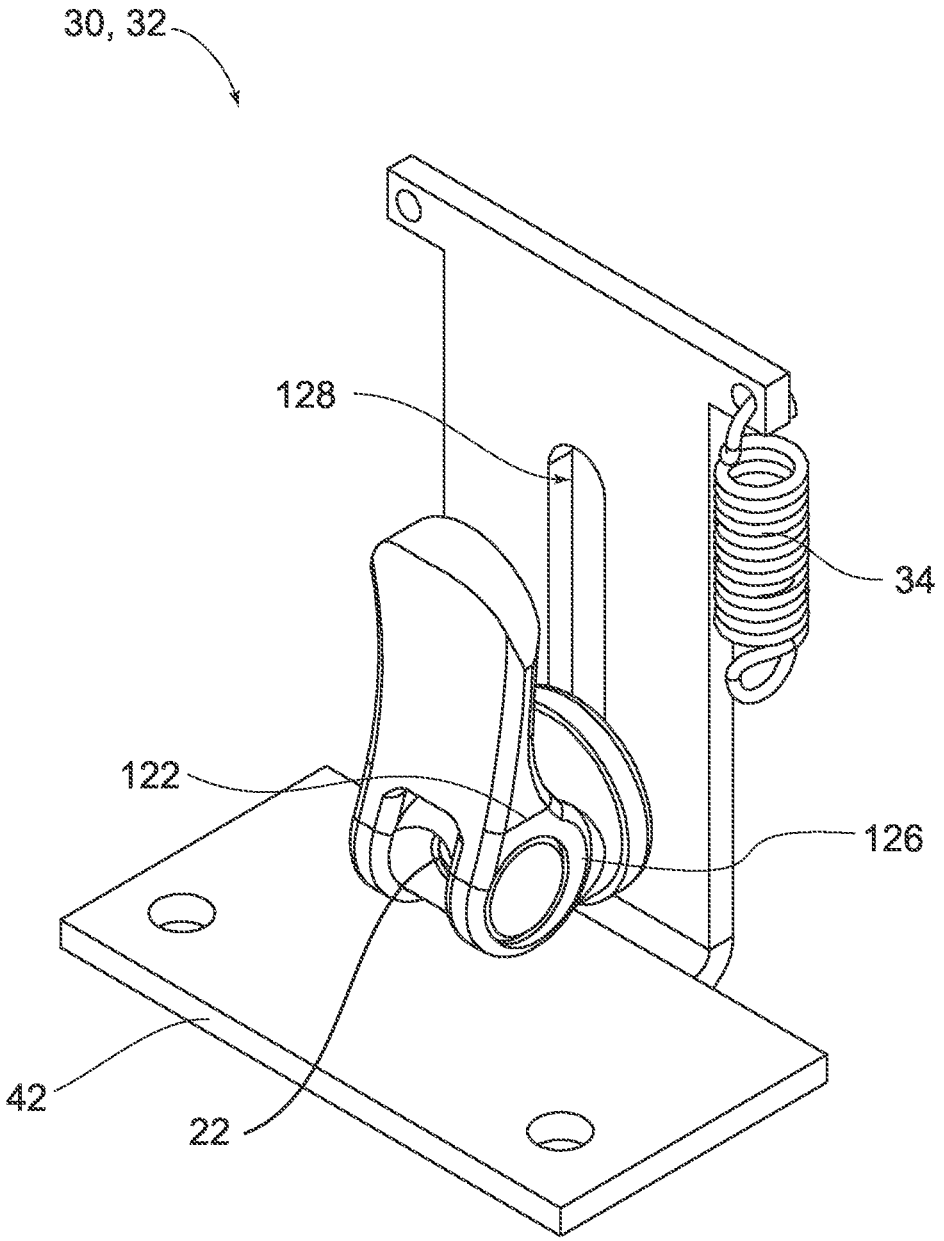
FIG. 15 is a perspective view of a spring-loaded guide, according to an embodiment.

The rail frame 12 may be overall smaller than, and configured to fit within, an opening of a window frame, leaving a gap between each of the four rail members 14, 16, 18, and 20 and the inner surfaces of the window frame, respectively. In some embodiments, the rail frame 12 is configured to be self-centering within the opening of the window frame. For example, the rail frame 12 may comprise at least one spring-loaded upper guide 30 coupled to the top rail 14 thereof and at least one spring-loaded lower guide 32 coupled to the lower rail 16 thereof. In a preferred embodiment, the rail frame 12 comprises two spaced spring-loaded upper guides 30 coupled to the top rail 14 thereof and two spaced spring-loaded lower guides 32 coupled to the lower rail 16 thereof. In such embodiments, as shown in FIG. 15, the spring-loaded upper and lower guides 30 and 32 are L-shaped members with a vertical portion 33 and horizontal portion 35, wherein springs 34 of the spring-loaded guides 30 and 32 operate to bias the guides 30 and 32 against the top and bottom inner surfaces of the window frame, respectively, such that the rail frame 12 is self-centered between the top and bottom inner surfaces of the window frame. Although the window frame may be slightly out-of-square, and/or the top and bottom inner surfaces of the window frame may not be exactly horizontal or parallel to each other, the spring force of each guide 30 and 32 may be independently adjustable, whereby the rail frame 12 may be rotated with respect to the window frame until the top and bottom rails 14 and 16 thereof are horizontal, in response to adjustment of the guides 30 and 32. The horizontal portions of the guides 30 and 32 may be coupled to inner portions of the bottom and top window frame respectively with screws through apertures in the horizontal portions 33, wherein rear surfaces 42 thereof engage the inner surface of the window pane or framework thereof to provide proper spacing from the window to allow for rotation of the louvers.

Figure 16:
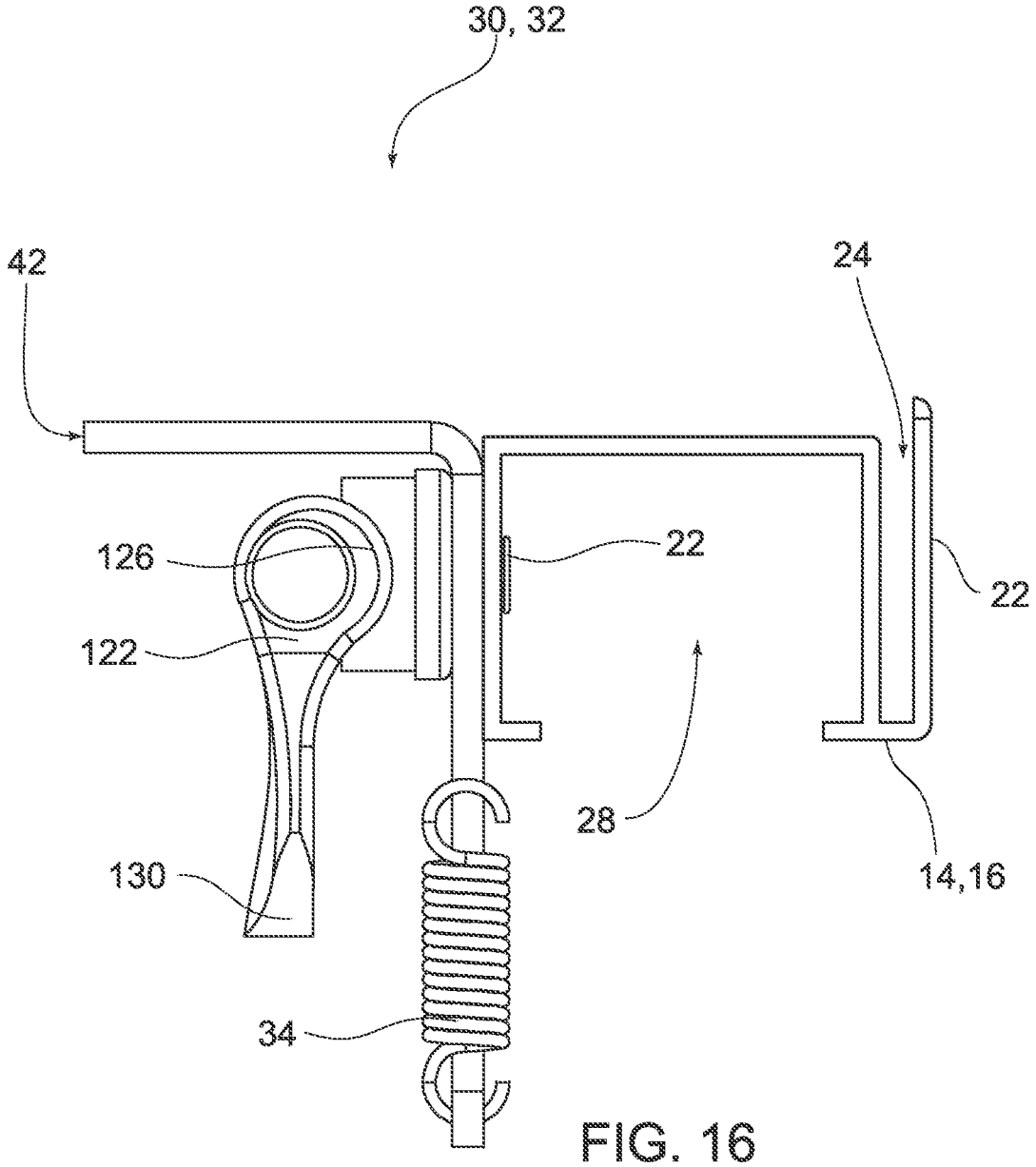
FIG. 16 is a side view of a spring-loaded guide of FIG. 15 coupled to a rail of a panel-less shutter assembly, according to an embodiment.

As shown in FIG. 16, the positions of the top and bottom rails 14 and 16, with respect to the guides 30 and 32, may be secured by a quick release skewer 122. A quick release skewer 122, as shown, comprises a threaded rod 22, coupled to each of the top and bottom rails 14 and 16, corresponding to each of the spring-loaded guides 30 and 32, and extending through a slot 128 formed in a vertical portion 35 of the L-shaped guide in the guide 30, 32. The quick release skewer 122 further comprises a lever-operated cam assembly 126. In operation, a user may release the cam assembly 126 by rotating lever 130 to a disengaged position, thereby allowing the rail 14, 16 to move freely with respect to the guide 30, 32. Then the user may secure the cam assembly 126 by rotating lever 130 to an engaged position, thereby securing the rail 14, 16 to the guide 30, 32. The rail frame 12 may be approximately centered between the left and right inner surfaces of the window frame by a user simply moving the rail frame 12 left or right, accordingly.

It is an advantage of embodiments of the present invention that the rail frame 12 is smaller than the opening of the window frame, and easily centered therein, in that manufacture of the rail frame 12 can be done without the added cost and time of precise measurements of the window opening. Rail frames 12 may thus be manufactured en masse to approximate standard window opening sizes without regard to precise fitting of a rail frame 12 to a particular window opening. A further advantage is that, with only minimal effort and without the need for precise measurements, the rail frame 12 may be leveled and trued within a window opening that is not level and/or not true.

Figure 6:
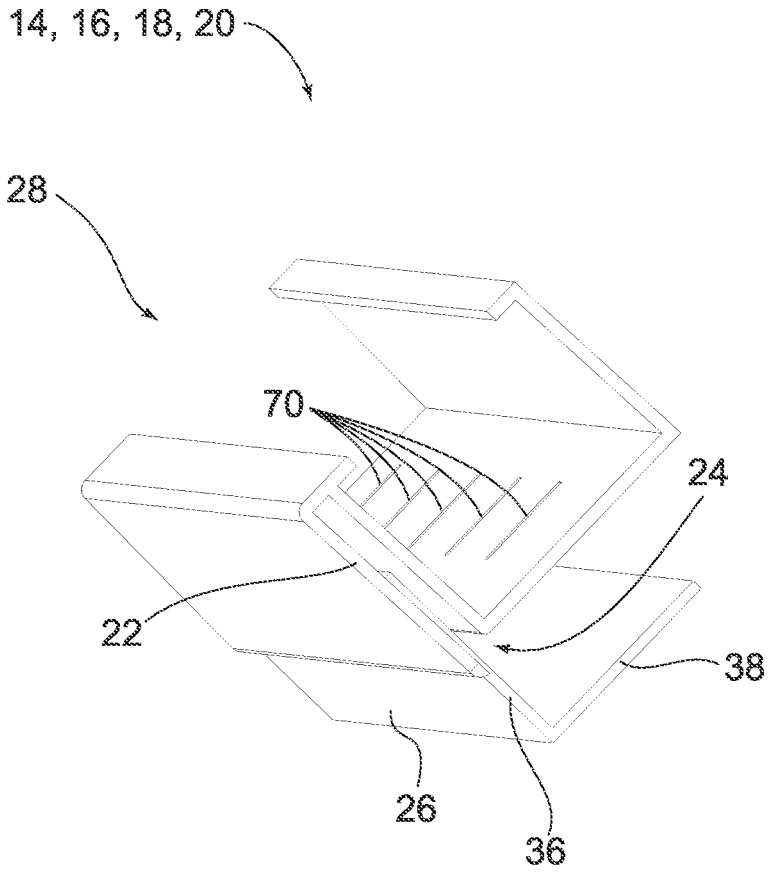
FIG. 6 is a perspective view of a rail with fascia of a panel-less shutter assembly, according to an embodiment.
Figure 14:
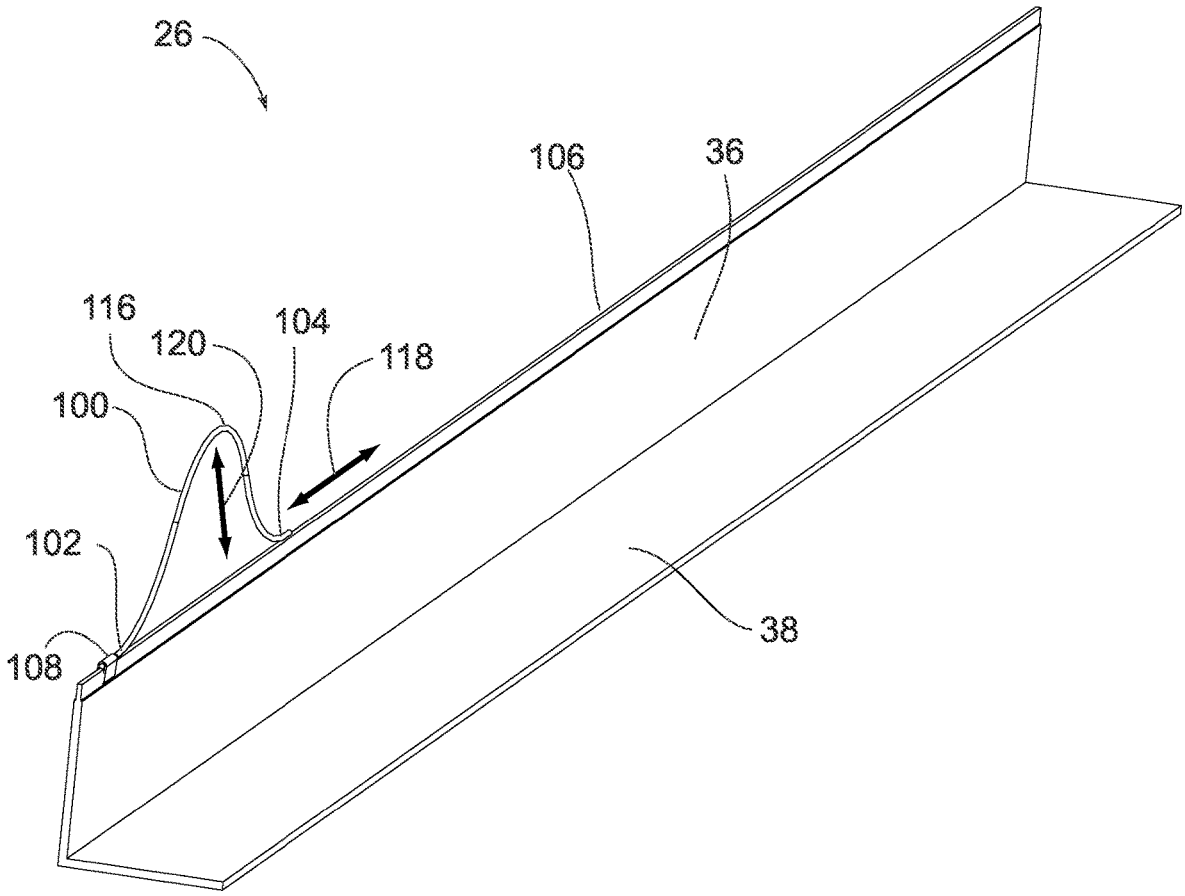
FIG. 14 is a perspective view of a fascia with a fascia tension spring, according to an embodiment.

In such embodiments, gaps remain around the perimeter of the rail frame 12 between each of the four rail members 14, 16, 18, and 20 and the inner surfaces of the window opening, respectively. As shown in FIG. 6, The gaps may be covered by fascia 26. For example, in a preferred embodiment, each of the top, bottom, left, and right gaps may be covered by a top, bottom, left and right fascia 26, respectively. Each of the fascia 26 may have an L-shaped contour, wherein a first leg 36 thereof is partially inserted into the groove 24, between the inner surface of the facing 22 and the outer surface of the arm of the rail 14, 16, 18, and 20, and the outer surface of the second leg 38 thereof is biased against the inner surface of the window opening, respectively. The fascia 26 may remain in place within the groove 24 by friction, or by other securing means, in some embodiments. In some embodiments, at least one fascia tension spring 100 may be coupled to the edge 106 of the first leg 36 of fascia 26, as shown in FIG. 14. Fascia tension spring 100 may be a U-shaped tension spring, as shown, or any other suitable tension spring, such as a coil spring, or the like. The U-shaped tension spring 100, as shown in FIG. 14, has a first end 102 and an opposed second end 104. The first end 102 is coupled to the edge 106, such as by a clip 108, or other suitable coupling device. The second end 104 is free to slide along edge 106, in a direction indicated by bidirectional arrow 118, in response to a force acting on vertex 116 of the fascia tension spring 100, in a direction indicated by bidirectional arrow 120. When the first leg 36 fascia 26 is inserted into the groove 24, as shown in FIG. 6, the vertex 116 of tension spring 100 is biased against the rail 14, 16, 18, or 20, accordingly, within the groove 24, thereby biasing the second leg 38 of fascia 26 against an inner surface of the window frame. Corner fascia 40 is free to slide with respect to one of rail 14, 16, 18, or 20, and with respect to an adjacent rail 14, 16, 18, or 20. This allows the corner fascia 40 to be biased firmly into the inside corner of a window opening in response to rail 14, 16, 18, or 20 and the adjacent rail 14, 16, 18, or 20 being biased against the inner walls of the window opening, thereby preventing any gaps between the corner fascia 40 and the inner walls of the window opening.

Figure 7:
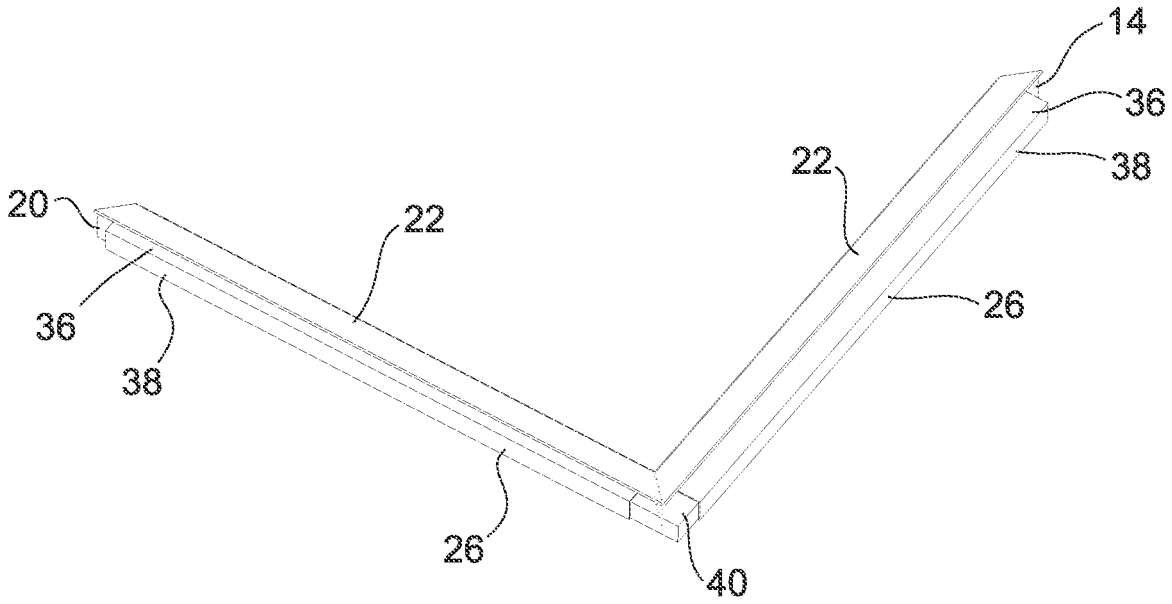
FIG. 7 is a perspective view of rails with fascia and corner fascia of a panel-less shutter assembly, according to an embodiment.

Because the first leg 36 thereof is only partially inserted into the groove 24, the fascia 26 may be oriented parallel to the inner surface of the window opening, rather than parallel to the rail 14, 16, 18 or 20, in the event the inner surface of the window opening is not level, plumb or, collectively true, so that the gap may be completely covered under any such condition. As shown in FIG. 7, this preferred embodiment may further comprise an L-shaped corner fascia 40 at each corner thereof, the corner fascia 40 having an L-shaped cross section, similar to the top, bottom, left and right fascia 26 described above. The four corner fascia 40 may similarly be partially inserted into the grooves 24 of adjoining rail members 14, 16, 18, and 20, respectively, to cover the gaps at the corners of the window frame. Each corner fascia 40 may overlap each adjoining top, bottom, left and right fascia 26, respectively, as shown.

Figure 8:
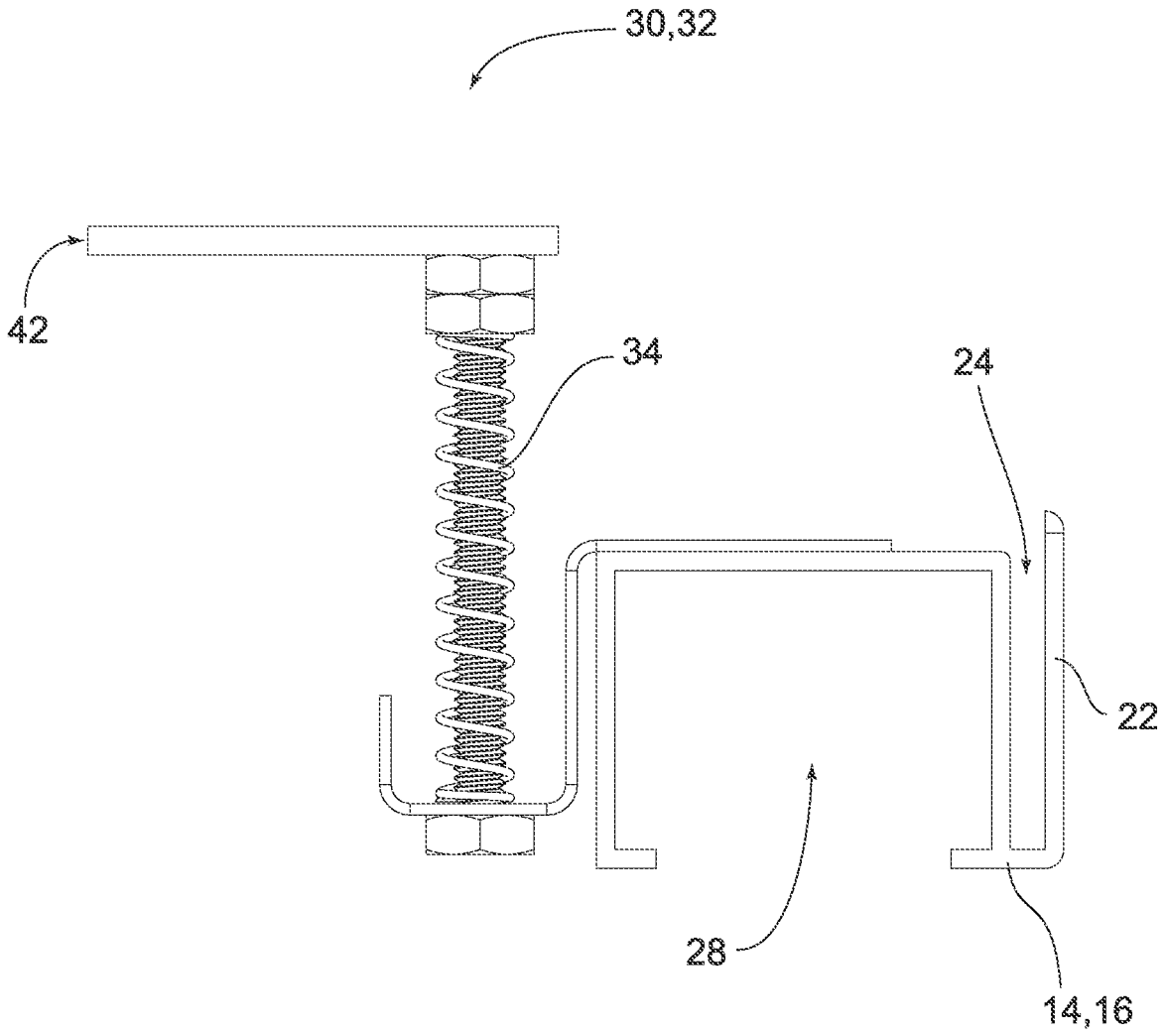
FIG. 8 is a detail of a spring-loaded guide coupled to a rail of a panel-less shutter assembly, according to an embodiment.

As shown in FIG. 8, in some embodiments, each of the guides 30 and 32 is of uniform depth and is configured to be disposed such that the rear surfaces 42 thereof engage the inner surface of the window pane or framework thereof. This feature is advantageous in that it eliminates the need for the time and expense of measuring the depth at which the rail frame 12 is inserted into the window frame. Furthermore, the rail frame 12 is thereby assuredly disposed parallel to the window pane at the proper predetermined distance from the window pane.

Figure 9:
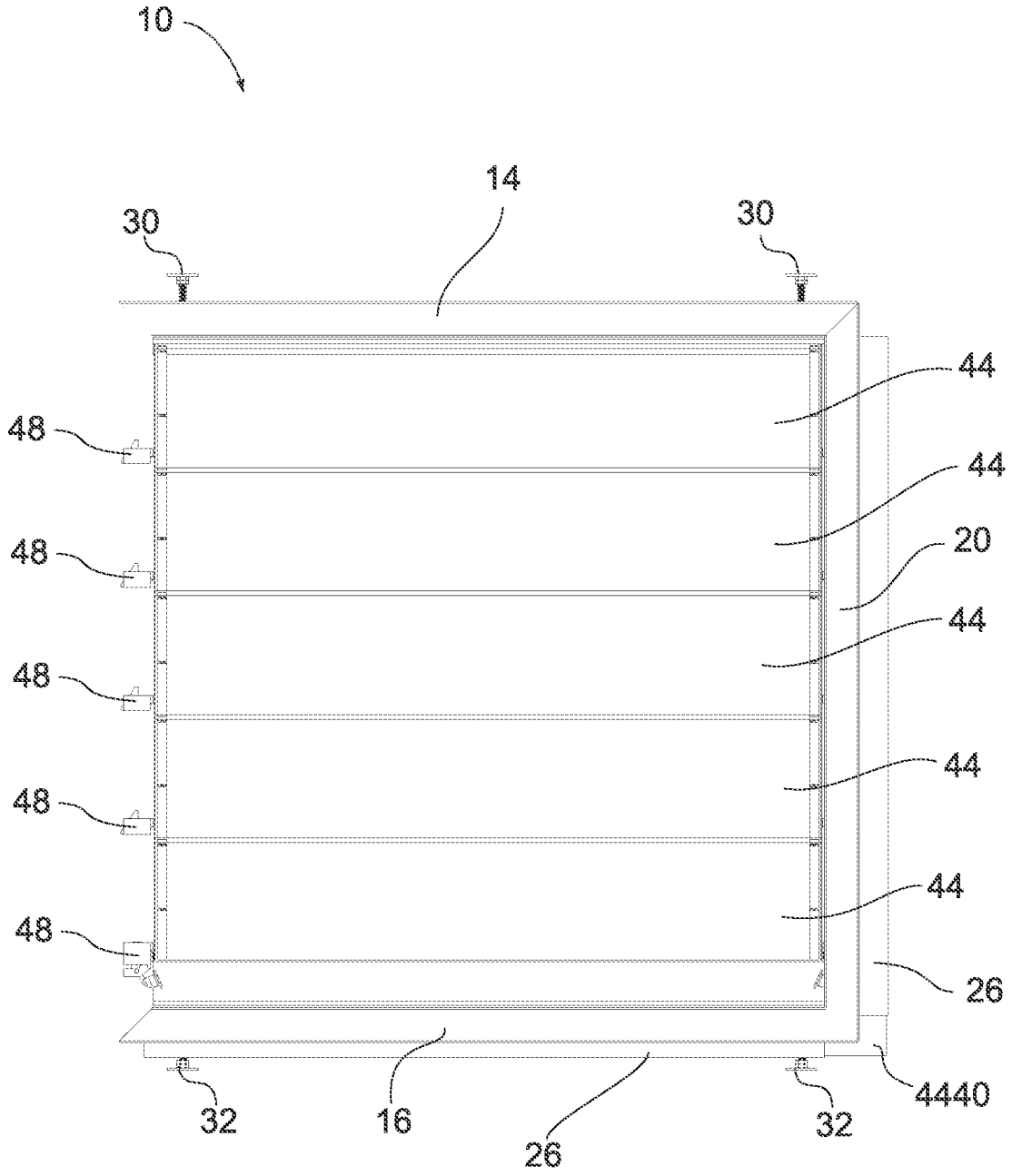
FIG. 9 is a front view of a panel-less shutter assembly, according to an embodiment.
Figure 10:
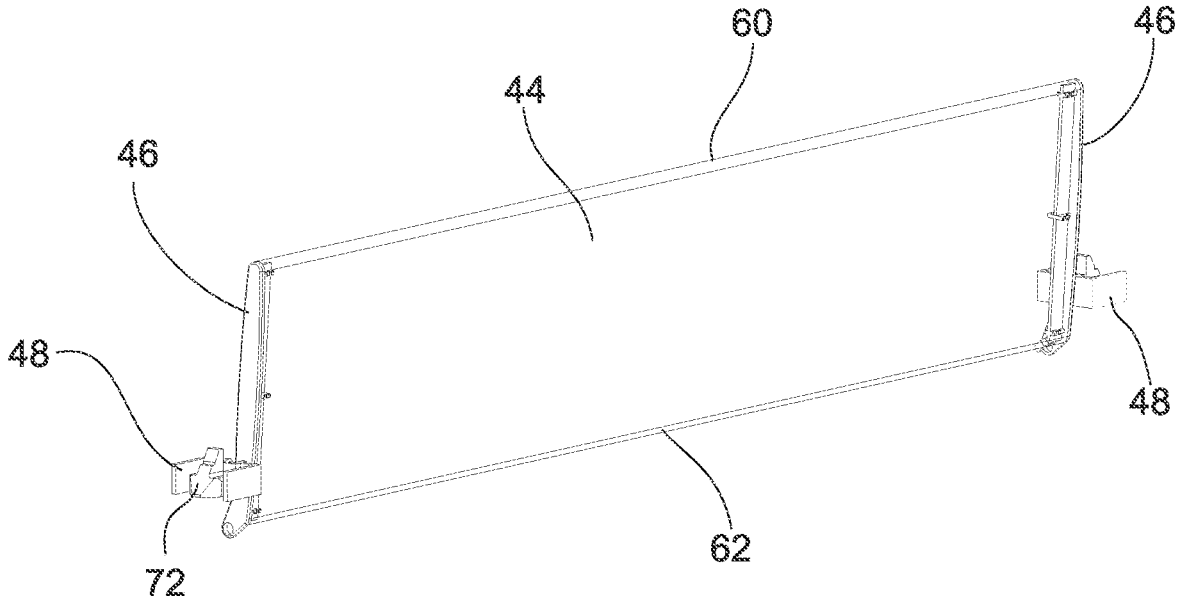
FIG. 10 is a perspective view of a louver of a panel-less shutter assembly, according to an embodiment.
Figure 11:
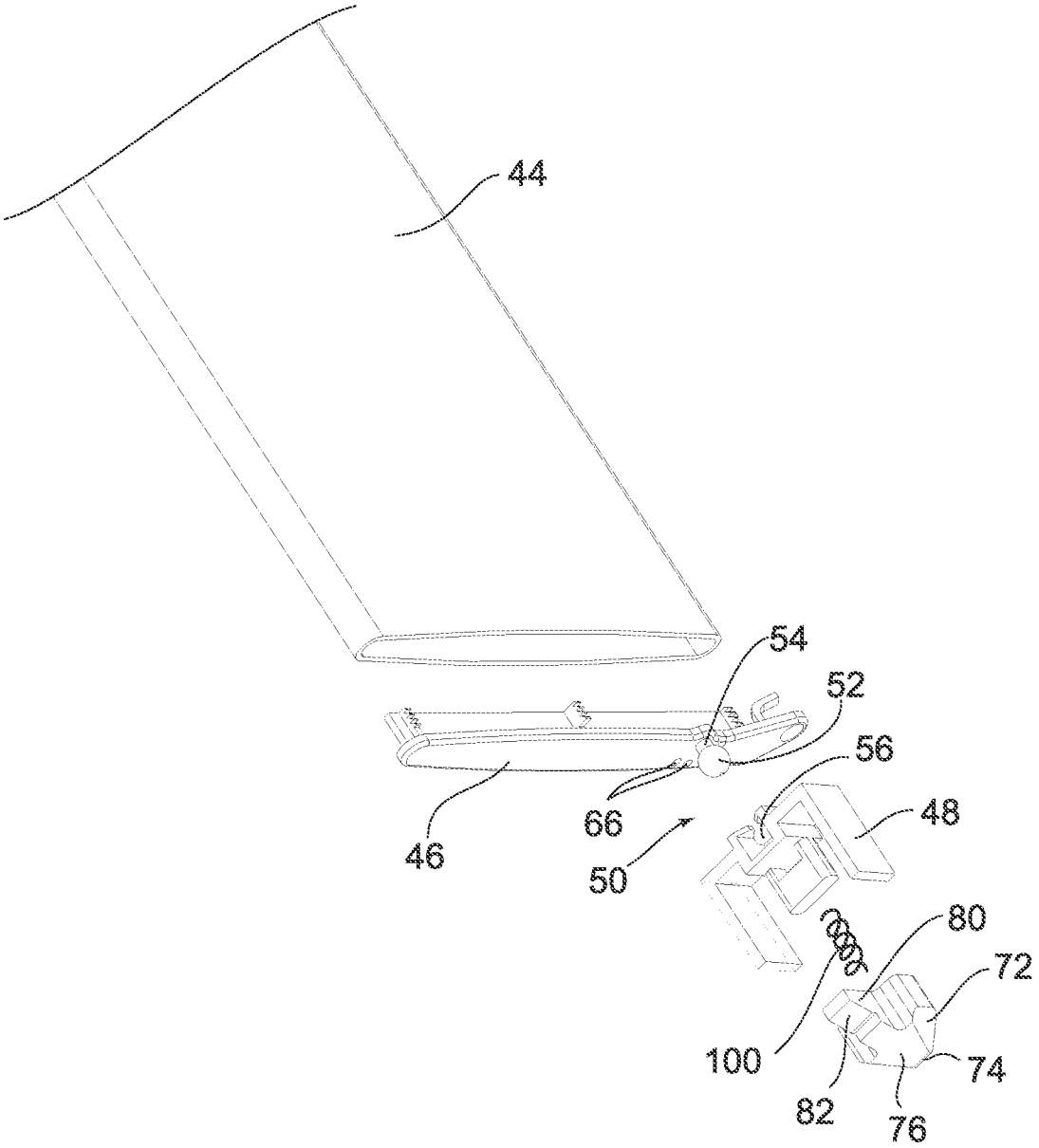
FIG. 11 is an exploded view of a louver of a panel-less shutter assembly, according to an embodiment.

As shown in FIG. 9, a panel-less shutter assembly 10 of the present invention further comprises a plurality of louvers 44 operationally mounted horizontally within the rail frame 12 in a parallel configuration. Each of the plurality of louvers 44 may be an elongated plank, of solid or hollow construction. In some embodiments, the louvers 44 may be hollow and have a substantially flat elliptical cross section, as shown in FIGS. 10 and 11. Such hollow louvers may have a pair of end caps 46 coupled thereto at each end thereof, respectively, to enclose the ends thereof. Each end of each of the plurality of louvers 44 may be rotationally coupled to a carrier 48 that is configured to be inserted into a channel 28 of the left and right vertical rails 18 and 20, respectively. Each louver 44 may thereby be rotated with respect to the carriers 48, about an axis of rotation, the axis of rotation coinciding with the line between the carrier 48 coupled to a first end of the louver 44 and the carrier 48 coupled to the second end of the louver 44. In some embodiments, the louver 44 is coupled to the carrier 48 by a ball joint 50, wherein a ball 52 thereof is coupled to a protrusion 54 extending from the end of the louver 44 and a ball catch 56 thereof is coupled to the carrier 48 for receiving the ball 52. Each carrier 48 is configured to slide up and down within the channels 28 of the left and right vertical rails 18 and 20, respectively, thereby allowing the louvers 44 to be raised and lowered with respect to the rail frame 12.

In some embodiments, each of the plurality of louvers 44 may be connected, in series, by a pair of flexible connecting devices (not shown), such as a cord, a rope, a string, a ribbon, a chain, or the like, wherein a first connecting device 58 is coupled to each of the first ends of the louvers 44, respectively, at equally-spaced intervals along the first connecting device 58, and a second connecting device 58 is coupled to each of the second ends of the louvers 44, respectively, at equally-spaced intervals along the second connecting device 58. In some embodiments, the connecting device 58 is a ball chain, comprising a rope, a string, a cord, a chain, or the like, and a plurality of spherical balls coupled thereto at spaced intervals. In such embodiments, a connecting device ball catch is coupled to each of the ends of each louver 44, and configured to receive each spherical ball therein, respectively, for hingedly coupling the louvers 44 to the connecting device 58. The connecting device ball catch coupled to each end of each louver 44 may be coupled near a bottom edge 62 thereof, such that, as a user rotates a louver 44 in a downward direction, all other louvers 44 below that rotated louver 44 will rotate downward in unison with the rotated louver. Thus, by rotating the uppermost louver 44 downward, all the other louvers 44 will rotate downward in unison. Similarly, as a user rotates a louver 44 to in an upward direction, all other louvers 44 above that rotated louver 44 will rotate upward in unison with the rotated louver. Thus, by rotating the bottommost louver 44 upward, all the other louvers 44 will rotate upward in unison.

Figure 12:
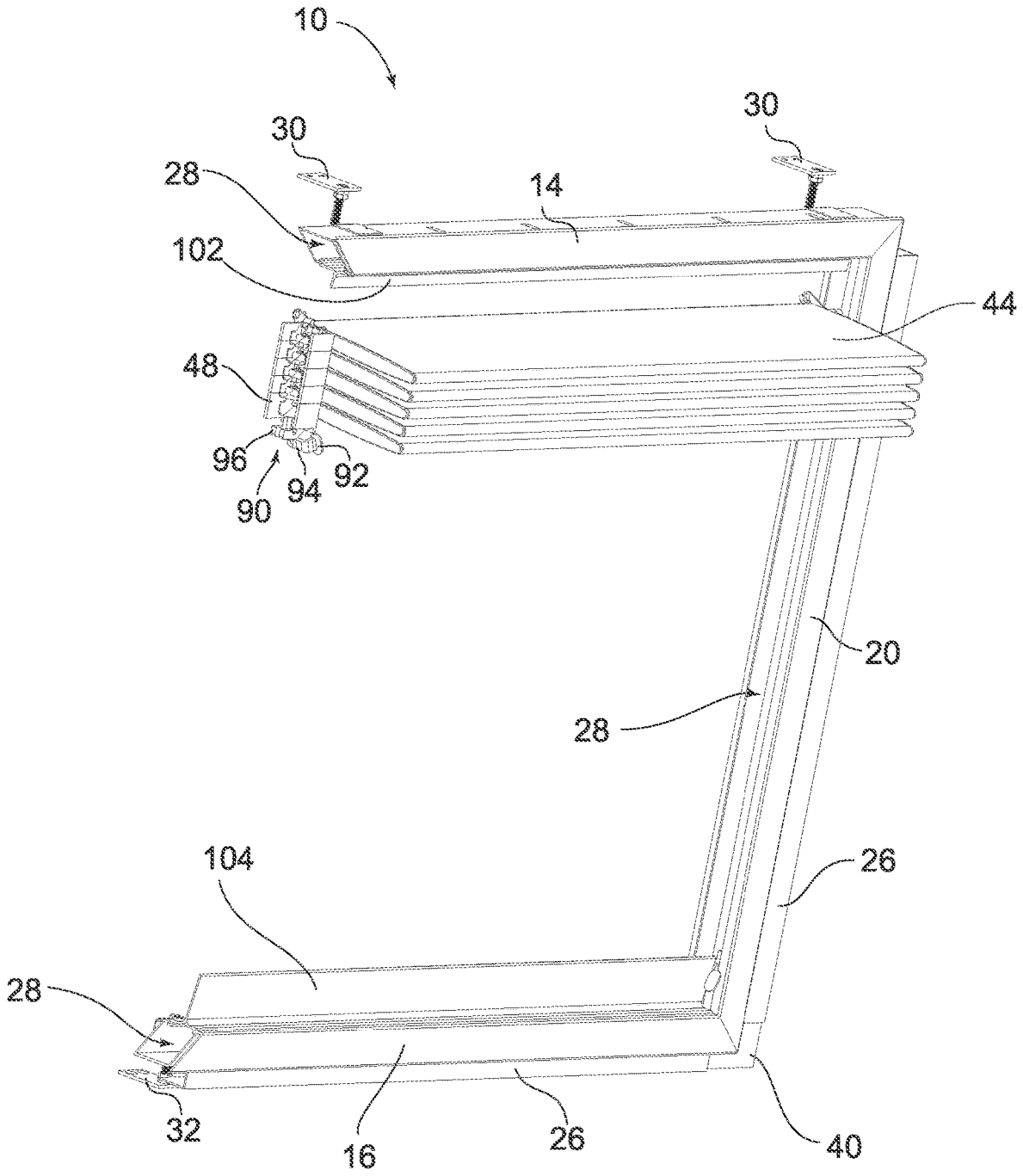
FIG. 12 is a perspective view of a panel-less shutter assembly having louvers in an open and stacked position, according to an embodiment.

While the louvers 44 are in the closed configuration, there remains a first gap between the uppermost louver 44 and the top rail 14 and a second gap between the lowermost louver 44 and the bottom rail 16. In some embodiments an upper louver stop 102, as shown in FIG. 12, may be coupled to and extend downward from the top rail 14 to fill the first gap and provide a surface against which the uppermost louver 44 may rest while in the open position. Furthermore, a lower louver stop 104, as shown in FIG. 12, may be coupled to and extend upward from the bottom rail 16 to fill the second gap and provide a surface against which the lowermost louver 44 may rest while in the open position.

Some embodiments may comprise one or more vertical center rails coupled between the bottom rail 16 and the top rail 14 at a position between the left and right side rails 18 and 20. A center rail divides the rail frame 12 into sections and is particularly useful in applications for wide window openings. Where a side rail 18 or 20 may have a generally U-shaped configuration, a center rail may have a generally H-shaped configuration, the center rail having two channels 28 on opposing sides thereof, respectively, for accommodating sets of louvers 44, with corresponding appurtenances, on either side of the center rail.

The distance between adjoining louvers 44 may be slightly smaller than the width of each louver 44, so that, while in a closed configuration, each louver 44 necessarily overlaps any adjoining louvers 44, thereby completely blocking light from passing between the louvers 44 while in a closed configuration. Furthermore, in some embodiments, the carriers 48 coupled to each end of each louver 44 may be coupled thereto at a location that is off-center between the top edge 60 and the bottom edge 62 of the louver 44. For example, the end of each louver 44 may be coupled to a carrier 48 at a location near the bottom edge 62 of the louver 44. Because the axis of rotation is therefore off-center, the louver 44 may tend to fall to an open position in response to the force of gravity acting on the louver 44. Each of the plurality of louvers 44, similarly configured, thereby tends to fall into the open position uniformly. While in the closed position, the angle of rotation of each louver 44 may be vertical, or nearly vertical, such that the force of gravity acting on the louver 44 is insufficient to cause the louver to fall into an open position, thereby allowing the louvers 44 to remain in the closed position.

Some embodiments may comprise a mechanism for allowing the louvers 44 to snap into an open position, a closed position, or any of a variety of positions between an open position and a closed position. For example, in some embodiments, such a mechanism may be a ball piston 64 and a plurality of corresponding ball detents 66, or any other suitable mechanical arrangement, between the ends of each louver 44 and the corresponding carriers 48 to which they are coupled, for temporarily holding the louver 44 in a fixed rotational position, or various fixed rotational positions, between an open position and a closed position, inclusively. In the embodiment, a ball piston 64 is coupled to the carrier 48 and the end cap 46 of the louver 44 comprises a series of corresponding ball detents 66.

The configuration of the plurality of louvers 44, as described above, coupled at the ends thereof to carriers 48 that slide upward and downward within the channels 28 of the vertical side rails 18 and 20, enables a user to lift the louvers 44 upward to a lifted configuration, as shown in FIG. 12. For example, in operation, a user may grasp the bottom louver 44 and lift it upward, thereby successively lifting each adjoining louver 44, until all of the louvers 44 are stacked together, and the stack of louvers engages the top rail 14 of the rail frame 12. The louvers 44 may then be allowed to fall back to their original positions by simply lowering the bottom louver 44 back to its original position.

In some embodiments, the outer surface of each of the vertical side rails 18 and 20 has a plurality of apertures 70 therethrough (or recesses formed therein), each aperture 70 corresponding to the position of each corresponding louver 44 when the louvers 44 are in their original, and not lifted, positions. A carrier slide 72 may be slidingly coupled to each carrier 48, wherein the carrier slide 72 has an outward tab 74 configured to extend outwardly through the aperture 70 while in the engaged position and retract inwardly, such that the outward tab 74 does not extend through the aperture 70, while in the disengaged position. The carrier slide 72 is configured to slide between the engaged position and the disengaged position. The carrier slide 72 may be spring-loaded, wherein a spring 100 is coupled between the carrier slide 72 and the carrier 48 such that the carrier slide 72 is biased in the engaged position, thereby extending the outward tab 74 thereof through the aperture 70, when no other forces act on the carrier slide 72 to disengage the carrier slide 72. When each of the two carrier slides 72, one at each end of the louver 44, is in the engaged position, the louver 44 is thereby securely suspended. The outward tab 74 of the carrier slide 72 may comprise an upper surface 76 that is slanted, such that, by a user lifting the louver 44 upward, the slanted upper surface 76 of the outward tab 74 engages the upper surface of the aperture 70, thereby overcoming the carrier slide spring 100 and pushing the carrier slide 72 inward to a disengaged position, allowing the louver 44 to be freely raised to a lifted position by the user. As the user lowers the louver 44 back to the original unlifted position, the spring 100 forces the carrier slide 72 outward, such that the outward tab 74 extends outward through the aperture 70 again, thereby securely suspending the louver 44. It should be understood that carriers 48 and carrier slides 72 at both ends of the louver 44 operate in a similar fashion, simultaneously and in concert, as the user raises and lowers the louver 44.

An additional advantage of the present invention is that each carrier slide 72 may further comprise an upward tab 80 extending upward therefrom, the upward tab 80 having an outer slanted surface 82, and a lower slot 84 through the lower surface of the carrier slide 72. The carrier 48 further comprises an inner slanted carrier surface 88. In operation, when a user lifts a first louver 44, wherein a second louver 44 is disposed directly above the first louver 44, the carrier slide 72 coupled to the first louver 44 slides inward to a disengaged position in response to the slanted upper surface 76 thereof engaging the upper surface of the aperture 70. The user may continue to raise the first louver 44 until the outer slanted surface 82 of the upward tab 80 is inserted upwardly through the lower slot 84 through the lower surface of the carrier slide 72 coupled to the second louver 44 until the outer slanted surface 82 of the first upward tab 80 engages the inner slanted surface 88 of the second carrier 48 such that the first carrier slide 72 is biased in a disengaged position by the second carrier slide 72. As each successive louver 44 is raised, each corresponding carrier slide 72 is thereby biased in a disengaged position by the carrier slide 72 above it, until all of the louvers 44 have been raised to the lifted position.

An assembly, comprising a carrier, a carrier slide slidingly coupled thereto, and a spring coupled between the carrier and the carrier slide, may be referred to as a carrier assembly.

In some embodiments, a trigger mechanism 90 may be operationally coupled to the bottom carrier 48, one trigger mechanism 90 being operationally coupled to each of the bottom carriers 48 at each end of the bottom louver 44, such that engagement of the trigger 90 by a user causes the bottom carrier slide 72 to slide inward to a disengaged position. For example, the trigger 90 may be a lever arm hingedly coupled at a middle location thereof to the bottom carrier 48, wherein pressing a thumb tab 92, on a first end 94 thereof, in an outward direction, causes the second end 96 thereof to move in an inward direction, engaging the bottom carrier slide 72 and moving it inward to a disengaged position.

In operation, in accordance with the above descriptions, a user may configure a panel-less shutter assembly 10, of the present invention, in any of a variety of ways. For example, while the louvers 44 are in the original unlifted position, with the carrier slides 72 in the engaged position extending through the respective apertures 70 in the side rails 18 and 20, a user may rotate the uppermost louver 44 downward, causing all the other louvers 44 to rotate downward in unison. Similarly, by rotating the bottommost louver 44 upward, all the other louvers 44 will rotate upward in unison. As the user rotates a louver, the ball piston 64 at each carrier 48 may engage successive ball detents 66 at each end of the louvers 44 to maintain the desired rotation angle of the louvers 44 between fully-open and fully-closed.

In addition, while the louvers 44 are in the open configuration, a user may lift all the louvers 44 to a lifted and stacked position by engaging the trigger mechanisms 90 to disengage the bottom carrier slides 72 and lifting the bottom louver 44, which, in turn causes the other louvers 44 to be lifted and stacked in succession. Furthermore, in some embodiments, while the louvers 44 are in the closed configuration, a user may engage the triggers 90 to disengage the bottom carrier slides 72 and lift the bottom louver 44. As the bottom louver 44 is lifted by the user, the tension in the connecting device 58 between the bottom louver 44 and the adjoining louver 44 is released, thereby allowing the bottom louver 44 to rotate into the open position by the force of gravity. Thereafter, as the louvers 44 are lifted, each successive louver 44 is freed to rotate into the open position by the force of gravity until all the louvers 44 are lifted and stacked in succession. In such embodiments, it is therefore not necessary to open the louvers 44 prior to lifting. Embodiments comprising a ball detent mechanism 66 for maintaining the rotational position of the louvers 44 will require the louvers 44 to be opened by the user prior to lifting because the ball detent mechanism 66 prevents the louvers 44 from falling open by the force of gravity. The louvers 44 may be maintained in the lifted configuration by allowing the bottom carrier slides 72 to engage (i.e. extend through) a pair of corresponding apertures 70 near the top of the side rail 18 or 20 to suspend the bottom louver 44 upon which the other louvers 44 are stacked. By engaging the triggers 90 again to disengage the bottom carrier slides 72, the louvers 44 may be allowed to fall again to their original unlifted positions.

Figure 13:
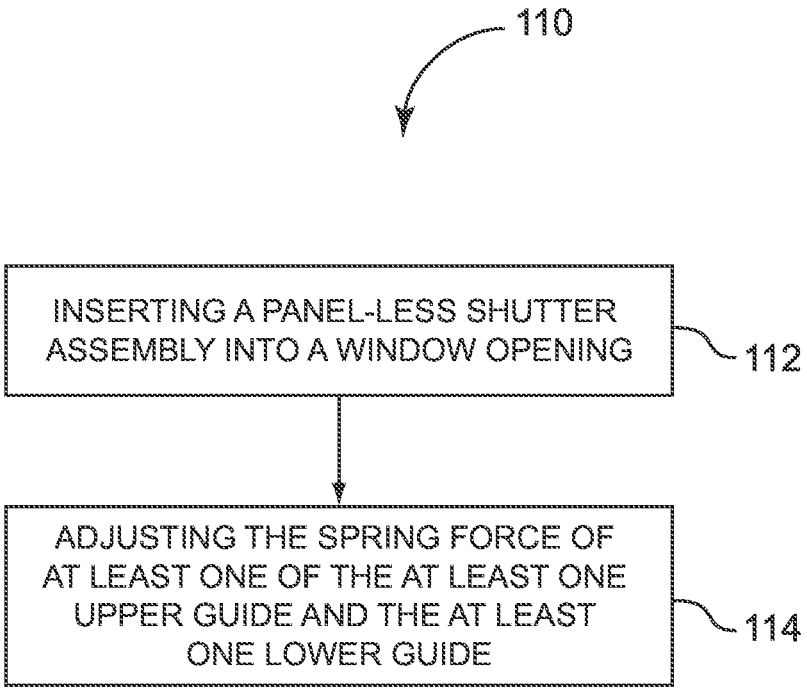
FIG. 13 is a block diagram of a method of using a panel-less shutter assembly, according to an embodiment.

FIG. 13 is a block diagram of steps of a method 110 of using a panel-less shutter assembly. The method 110 comprises inserting a panel-less shutter assembly into a window opening (Step 112), such that at least one upper guide engages an upper surface of the window opening and at least one lower guide engages a lower surface of the window opening such that the rail frame of the panel-less shutter assembly self-centers between the upper and lower surfaces of the window opening in response to opposing spring forces of the at least one upper guide and the at least one lower guide. The method 100 may further comprise adjusting the spring force of at least one of the at least one upper guide and the at least one lower guide (Step 114).

In addition, the method 110, may comprise: lifting the lowermost louver until it engages an adjacent louver above it; further lifting the lowermost louver to disengage the adjacent carrier slide from the adjacent louver above it in response to the upper slanted surface of the adjacent carrier slide engaging the upper surface of the adjacent slot, thereby overcoming the force of the spring between the adjacent carrier slide and the adjacent carrier; continuing to lift the lowermost louver until all of the louvers are successively lifted to a lifted and stacked position and the uppermost louver engages the top rail; and maintaining the louvers in the lifted and stacked position by allowing the lowermost carrier slide to engage a corresponding slot proximate the top rail.

Furthermore, the method 110 may comprise engaging a trigger to disengage the lowermost carrier slide from the corresponding slot.

The components defining any panel-less shutter assembly may be formed of any of many different types of materials or combinations thereof that can readily be formed into shaped objects provided that the components selected are consistent with the intended operation of a panel-less shutter assembly. For example, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as copper, zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any panel-less shutter assembly may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, sewing, any combination thereof, and/or the like for example, depending on, among other considerations, the particular material forming the components. Other possible steps might include sand blasting, polishing, powder coating, zinc plating, anodizing, hard anodizing, and/or painting the components for example.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

What is claimed is:

1. A panel-less shutter assembly comprising:

a rail frame, further comprising:

a top rail;

a bottom rail disposed parallel to the top rail;

a left side rail coupled between the top rail and the bottom rail; and a right side rail coupled between the top rail and the bottom rail, the right side rail being disposed parallel to the left side rail, wherein each of the top rail, the bottom rail, the left side rail, and the right side rail has a U-shaped cross section, an outer surface, and a channel, wherein the channel faces inward toward a center of the rail frame, wherein the outer surface of each of the left side rail and the right side rail has a plurality of apertures therethrough, the plurality of apertures being equally spaced along a length of the outer surface;

a plurality of louvers, further comprising:

a lowermost louver;

an uppermost louver; and at least one middle louver disposed between the lowermost louver and the uppermost louver, the plurality of louvers being arranged in parallel and coupled between the left side rail and the right side rail, each of the plurality of louvers having a first end and an opposed second end, wherein each of the plurality of louvers is rotatable about a longitudinal axis thereof between an open position and a closed position;

a plurality of carrier assemblies, wherein each of the first and second ends of each of the plurality of louvers is coupled to one of the plurality of carrier assemblies, respectively, each of the plurality of carrier assemblies further comprising:

a carrier rotatably coupled to the first or second end of each louver of the plurality of louvers and slidingly coupled within the channel of the left side rail or the right side rail, wherein the carrier slides upward or downward in the channel of the left side rail or the right side rail between a lifted position and an unlifted position, respectively, in response to a user raising or lowering the louver, respectively; and a carrier slide slideably coupled to the carrier, wherein the carrier slide is biased outwardly from the carrier, each carrier slide further comprising:

an outward tab extending outward therefrom, wherein the outward tab extends through an aperture of the plurality of apertures in an engaged position when the louver is aligned with the aperture, and wherein, when the louver is raised, an upper edge of the aperture of the plurality of apertures engages a slanted upper surface of the outward tab, forcing the carrier slide inward, to disengage the outward tab from the aperture; and an upward tab extending upward therefrom and a lower slot in a bottom surface, wherein the upward tab of a carrier slide of a first carrier assembly of the plurality of carrier assemblies reversibly extends into the lower slot in a bottom surface of a carrier slide of an adjacent second carrier assembly of the plurality of carrier assemblies located above the first carrier assembly when the carrier slide of the first carrier assembly is in a disengaged position and the carrier slide of the first carrier assembly is lifted to contact the carrier slide of the second carrier assembly, thereby maintaining the carrier slide of the second carrier assembly in the disengaged position.

2. The panel-less shutter assembly of claim 1, further comprising:

at least one upper guide coupled to the top rail and extending upward therefrom; and at least one lower guide coupled to the bottom rail and extending downward therefrom, wherein the at least one upper guide is configured to engage the upper surface of a window opening and the at least one lower guide is configured to engage the lower surface of the window opening, wherein each of the at least one upper guide and the at least one lower guide is spring-loaded, and wherein the rail frame self-centers between the upper and lower surfaces of the window opening in response to a downward spring force of the at least one upper guide and an opposing upward spring force of the at least one lower guide.

3. The panel-less shutter assembly of claim 2, wherein the downward spring force of the at least one upper guide and the upward spring force of the at least one lower guide are each adjustable.

4. The panel-less shutter assembly of claim 2, wherein each of the at least one upper guide and the at least one lower guide comprises a rear surface that is configured to engage a window pane of the window opening, thereby establishing a position of the rail frame a pre-determined distance from the window pane.

5. The panel-less shutter assembly of claim 4, wherein each of the top rail, the bottom rail, the left side rail, and the right side rail, comprises:

a facing coupled thereto forming a groove between the facing and the rail; and a fascia partially inserted into the groove, the fascia being configured to conceal a gap between the rail and a corresponding surface of the window opening.

6. The panel-less shutter assembly of claim 5, further comprising:

at least one fascia tension spring coupled between each of the top rail, the bottom rail, the left side rail, and the right side rail, and the respective fascia partially inserted into the groove thereof, wherein the at least one fascia tension spring biases the fascia against the corresponding surface of the window opening.

7. The panel-less shutter assembly of claim 6, further comprising four corner fascia, each of the four corner fascia being partially inserted into the groove of one of the top rail or the bottom rail and partially inserted into the groove of one of the right side rail or the left side rail, wherein each of the four corner fascia is configured to conceal a gap between a top-right, top-left, bottom-right, or bottom-left corner of the rail frame, respectively, and a corresponding corner of the window opening.

8. The panel-less shutter assembly of claim 1, wherein each carrier assembly is rotatably coupled to the first end or the second end of a louver of the plurality of louvers by a ball joint aligned with the axis of rotation, the ball joint being disposed off-center between the front and rear edges of the louver.

9. The panel-less shutter assembly of claim 1, further comprising at least one detent mechanism coupled between a louver of the plurality of louvers and a carrier assembly to resist rotation of the louver from any of a plurality of pre-determined rotation angles.

10. The panel-less shutter assembly of claim 1, further comprising at least one center rail coupled between the top rail and the bottom rail.

11. The panel-less shutter assembly of claim 1, further comprising:

an upper louver stop coupled to the top rail and extending downward therefrom to conceal a gap between the uppermost louver and the top rail; and a lower louver stop coupled to the bottom rail and extending upward therefrom to conceal a gap between the lowermost louver and the bottom rail.

12. A panel-less shutter assembly comprising:

a frame, further comprising:

a top rail;

a bottom rail disposed parallel to the top rail;

a left side rail coupled between the top rail and the bottom rail; and a right side rail coupled between the top rail and the bottom rail, the right side rail being disposed parallel to the left side rail, wherein each of the top rail, the bottom rail, the left side rail, and the right side rail has a U-shaped cross section and a channel, wherein the channel faces inward toward a center of the frame;

at least one upper guide coupled to the top rail and extending upward therefrom; and at least one lower guide coupled to the bottom rail and extending downward therefrom, wherein the at least one upper guide is configured to engage an upper surface of a window opening and the at least one lower guide is configured to engage a lower surface of the window opening to self-center the frame between the upper and lower surfaces of the window opening; and a plurality of louvers arranged in parallel and coupled between the left side rail and the right side rail, each louver of the plurality of louvers being rotatable about a longitudinal axis of rotation between an open position and a closed position, wherein each of the at least one upper guide and the at least one lower guide comprises a rear surface that is configured to engage a window pane of the window opening, thereby establishing a position of the frame a pre-determined distance from the window pane.

13. The panel-less shutter assembly of claim 12, wherein the at least one upper guide is configured to engage the upper surface of the window opening and the at least one lower guide is configured to engage the lower surface of the window opening, wherein each of the at least one upper guide and the at least one lower guide is spring-loaded, and wherein the rail frame self-centers between the upper and lower surfaces of the window opening in response to an adjustable downward spring force of the at least one upper guide and an opposing adjustable upward spring force of the at least one lower guide.

14. The panel-less shutter assembly of claim 13, wherein each of the top rail, the bottom rail, the left side rail, and the right side rail, comprises:

a facing coupled thereto forming a groove between the facing and one of the top rail, the bottom rail, the left side rail, and the right side rail; and a fascia partially inserted into the groove, the fascia being configured to conceal a gap between one of the top rail, the bottom rail, the left side rail, and the right side rail and a corresponding surface of the window opening.

15. The panel-less shutter assembly of claim 14, further comprising four corner fascia, each of the four corner fascia being partially inserted into the groove of one of the top rail or the bottom rail and partially inserted into the groove of one of the right side rail or the left side rail, wherein each of the four corner fascia is configured to conceal a gap between a top-right, top-left, bottom-right, or bottom-left corner of the frame, respectively, and a corresponding corner of the window opening.

* * * * *